US005860849A

United States Patent [19]

Miller

[11] Patent Number: 5,860,849

[45] Date of Patent: Jan. 19, 1999

[54] LIQUID ABRASIVE JET FOCUSING TUBE FOR MAKING NON-PERPENDICULAR CUTS

[76] Inventor: Mitchell O. Miller, 1050 Huffman Way, Clover, N.C. 29710

[21] Appl. No.: 823,132

[22] Filed: Mar. 25, 1997

[51] Int. Cl.[6] ..... B24B 1/00; B24C 1/00

[52] U.S. Cl. ..... 451/40; 451/102; 451/99

[58] Field of Search ..... 451/102, 99, 75, 451/87, 40, 38, 444, 78, 79; 83/107; 239/423

[56] References Cited

U.S. PATENT DOCUMENTS

| | | | |
|---|---|---|---|
| 1,889,979 | 12/1932 | Falardeau | 451/102 |
| 1,907,196 | 5/1933 | Aitken | 451/79 |
| 1,944,404 | 1/1934 | Coble et al. . | |
| 2,900,851 | 8/1959 | Rutledge | 451/102 |
| 3,109,262 | 11/1963 | Weaver et al. | 451/102 |
| 3,865,202 | 2/1975 | Takahashi et al. . | |
| 4,648,215 | 3/1987 | Hashish et al. . | |
| 4,663,893 | 5/1987 | Savanick et al. . | |
| 4,703,814 | 11/1987 | Nguyen . | |
| 4,768,709 | 9/1988 | Yie | 451/102 |
| 4,787,845 | 11/1988 | Valentine | 451/102 |
| 4,827,680 | 5/1989 | Rushing et al. . | |
| 4,854,091 | 8/1989 | Hashish et al. | 451/38 |
| 4,902,073 | 2/1990 | Tomlinson et al. . | |
| 4,951,429 | 8/1990 | Hashish et al. . | |
| 4,955,164 | 9/1990 | Hashish et al. . | |

FOREIGN PATENT DOCUMENTS

| | | |
|---|---|---|
| 62-9873 | 1/1987 | Japan . |

*Primary Examiner*—Timothy V. Eley
*Assistant Examiner*—Derris H. Banks
*Attorney, Agent, or Firm*—Kennedy, Covington, Lobdell, & Hickman, LLP

[57] ABSTRACT

A liquid abrasive jet focusing tube for making cuts in a workpiece at a predetermined non-perpendicular angle, and a method for making non-perpendicular cuts in a workpiece with a liquid abrasive jet. The focusing tube includes a body having an inlet end which defines an inlet opening, an outlet end which defines an outlet opening, and a cylindrical passage which extends between the openings and which has a longitudinal axis. The outlet end has a tip portion with an angled surface adjacent the outlet opening and oriented in relation to the passage axis at the predetermined non-perpendicular angle. The method includes positioning the focusing tube so that the angled surface is generally parallel to the workpiece surface and the passage axis is oriented in relation to the workpiece surface substantially at the predetermined non-perpendicular angle.

8 Claims, 3 Drawing Sheets

LIQUID ABRASIVE JET FOCUSING TUBE FOR MAKING NON-PERPENDICULAR CUTS

BACKGROUND OF THE INVENTION

The present invention relates generally to liquid abrasive jet cutting devices and, more particularly, to a focusing tube for a liquid abrasive jet cutter for making non-perpendicular cuts in a workpiece.

It is known generally to use a high velocity liquid abrasive jet for making precise cuts in a variety of materials. Liquid abrasive jets are typically formed by producing a forceful stream of liquid at high pressure, aligning the liquid jet with a focusing tube, introducing fine abrasive particles into the liquid jet stream at an inlet end of the focusing tube, and accelerating the abrasive particles through the length of the focusing tube to form a stream of liquid and abrasive which is discharged at the outlet end of the tube onto a workpiece to be cut.

For the liquid abrasive jet to have sufficient cutting power, the stream of liquid and abrasive particles must be tightly concentrated in a coherent pattern as it strikes the workpiece. Maintenance of a coherent stream is essential if the liquid or abrasive jet is to have effective cutting power and to allow the jet to cut with a small kerf or hole, as is required for precision cutting operations.

The distance which the jet of liquid and abrasive must travel from the focusing tube tip to the workpiece, known as the stand-off distance, has a significant effect on the coherence of the jet pattern, since the jet rapidly disperses over distance. The liquid/abrasive jet also quickly loses energy as it moves away from the focusing tube, thereby resulting in a loss of effective cutting power. Therefore, it is desirable to place the outlet end of the focusing tube as close to the workpiece as possible, in order to reduce the stand-off distance.

For cuts that are to be made generally perpendicular to the surface of the workpiece, positioning of the focusing tube immediately adjacent the workpiece surface does not present any unusual problems. However, for cuts that are to be made at a non-perpendicular angle to the workpiece surface, minimizing the distance between the focusing tube tip and the surface to be cut can be difficult. Conventional focusing tubes are often formed in a cylindrical configuration, with a relatively thick cylinder wall that is squared at the tip of the tube so as to prevent chipping or other damage to the tip. Hashish et al U.S. Pat. Nos. 4,648,215 and 5,320,289 both disclose focusing tubes of this type, with the focusing tube disclosed therein being referenced as a "nozzle." Focusing tubes having an outlet end which is evenly tapered in a frusto-conical configuration are also known, as disclosed in Hashish et al U.S. Pat. No. 4,955,146. It is not desirable for the end to taper continuously down to form a knife edge at its extremity, however, as such a configuration would be particularly vulnerable to chipping or breakage in handling, while the thin knife edge would also quickly wear away as a result of the abrasive action of the jet. Consequently, conventional focusing tubes having a tapered outlet end typically include a squared-off portion at the extreme end to eliminate formation of a knife edge.

None of the above-described focusing tube configurations permit the tube to be positioned immediately adjacent the workpiece surface for a non-perpendicular cut. Thus, the liquid abrasive jet loses cutting power and produces a wider kerf than is desirable. A need, therefore, exists for a liquid abrasive jet focusing tube which minimizes the stand-off distance for non-perpendicular cuts.

SUMMARY OF THE INVENTION

In accordance with the present invention, a liquid abrasive jet focusing tube is provided for forming a precision cut in a workpiece at a predetermined non-perpendicular angle with the surface of the workpiece while minimizing the distance between the focusing tube and the workpiece, so that the coherence of the jet is maintained. The focusing tube comprises a body having an inlet end which defines an inlet opening, an outlet end which defines an outlet opening, and a cylindrical passage which extends between the inlet and outlet openings. The outlet end of the body has a tip portion, and the outlet opening is disposed thereat. In order to allow the focusing tube to be positioned immediately adjacent the workpiece, the tip portion has an angled surface adjacent the outlet opening that is oriented in relation to the axis of the central passage at a predetermined non-perpendicular angle. Accordingly, for non-perpendicular cuts, the focusing tube can be positioned closely adjacent the surface of the workpiece, with the angled surface of the focusing tube immediately adjacent the workpiece surface.

The tip portion may be generally frusto-conical in form, and the outlet opening may be disposed at the vertex of the tip portion.

In a preferred embodiment, the focusing tube includes a substantially planar surface adjacent the outlet opening and oriented substantially perpendicular to the axis of the passage, which allows the focusing tube to terminate in a blunted end without a knife edge or other thin, relatively weak position. The tip portion of the focusing tube advantageously tapers to its vertex along a predetermined angle of taper, and the angle of orientation of the angled surface is greater than the angle of taper.

The present invention also includes a method of making a precision cut with a liquid abrasive jet in a workpiece at a predetermined non-perpendicular angle. The method includes the steps of providing a liquid abrasive jet focusing tube which has a body with an inlet end defining an inlet opening, an opposed outlet end defining an outlet opening, and a cylindrical central passage extending between the openings and having a longitudinal axis. The outlet end has a generally frusto-conical tip portion with a vertex and an angled surface adjacent the outlet opening and is oriented in relation to the passage axis at the predetermined non-perpendicular angle. The method further includes positioning the focusing tube so that the angled surface is generally parallel to the workpiece surface and the passage axis is oriented in relation to the workpiece surface substantially at the predetermined non-perpendicular angle, and propelling the abrasive liquid jet through the passage, out of the outlet opening, and on to the workpiece surface to make a precision cut through the workpiece.

Accordingly, the present invention provides a liquid abrasive jet focusing tube and a method for effectively and efficiently forming a precision cut in a workpiece at a non-perpendicular angle, so that the integrity of the jet is preserved, cutting power is maintained, and a high degree of precision in making cuts is possible.

DESCRIPTION OF THE PREFERRED EMBODIMENT

Figure 1:
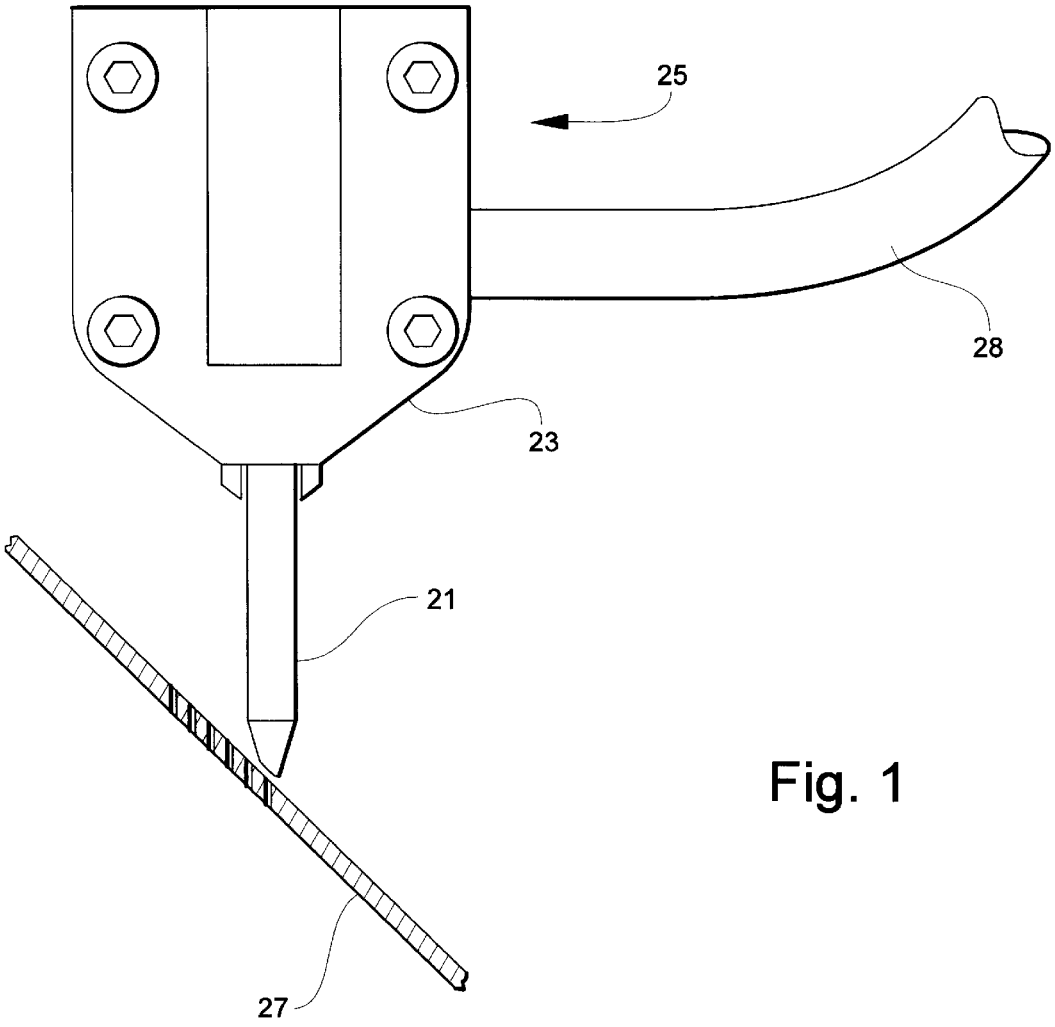
FIG. 1 is a perspective view of a liquid abrasive jet focusing tube according to the preferred embodiment of the present invention shown mounted in a liquid abrasive jet system.

Looking now in greater detail at the accompanying drawings, and more particularly at FIG. 1, a cutting unit for a liquid abrasive jet system is illustrated generally at 25 and includes a focusing tube 21 mounted in a clamping bracket 23 performing a non-perpendicular cut in a workpiece 27. The workpiece 27 may be a metallic generally planar member, such as may be used for aircraft skin, or virtually any other piece in need of non-perpendicular cutting. It should be noted that the cutting unit 25 is diagrammatically illustrated as further indication that the focusing tube of the present invention is adaptable to many types of jet cutters, both liquid and pneumatic. The liquid abrasive jet system cutting unit 25 is conventional and produces a high pressure liquid jet, seen generally at 37 in FIG. 2, into which abrasive particles are introduced to form a cutting jet which is discharged through the focusing tube 21 onto the workpiece 27 for cutting operations. Abrasive particles are supplied to the system by abrasive feed tube 28 from a conventional abrasive supply (not shown).

Liquid abrasive jets, often referred to as abrasive waterjets, frequently employ water as the carrier liquid with which abrasive particles are mixed, although other liquids may be used for certain applications, and the scope of the present invention includes use of all types of liquid abrasive jets. The abrasive particles are typically composed of garnet, silica, aluminum oxide, or other suitable substance of the appropriate size to pass through the focusing tube in the conventional manner.

The liquid jet is typically formed by elevating the liquid to a high operating pressure and forcing the pressurized liquid through a pierced jewel (not shown) such as synthetic sapphire or other orifice to form a liquid jet. The jewel orifice typically has a diameter approximately the size of a human hair, i.e., 0.001 to 0.015 inches.

The abrasive particles will then be introduced into the liquid jet in a mixing area (not shown), as is known, by conducting them into the low pressure area which surrounds the moving liquid jet in accordance with the Bernoulli Principle. The abrasive particles are entrained in the jet and then carried into a focusing tube or nozzle and accelerated therethrough by the high velocity liquid jet so as to form a combined liquid abrasive jet which has the capacity to precisely cut materials having a high degree of hardness, including tool steel, aluminum, cast iron armor plate, and bulletproof glass. In addition, highly brittle materials, such as certain ceramics, can also be effectively and accurately cut by a liquid abrasive jet.

Liquid abrasive jets are frequently employed for use in applications where cutting or drilling of holes must be accomplished with an extraordinarily high degree of precision, such as may be required in the aerospace and electronics industries. In such high precision applications, liquid abrasive jets can be readily employed in automated cutting machines, such as those operated by computer numeric control (CNC), which can provide the degree of precision required for advanced cutting operations.

The liquid abrasive jet system 25 as described so far is conventional, and the details of its operation are well-known to those in the art. Further details of the operation of the jet system apart from the focusing tube 21 of the present invention will therefore be omitted.

Figure 2:
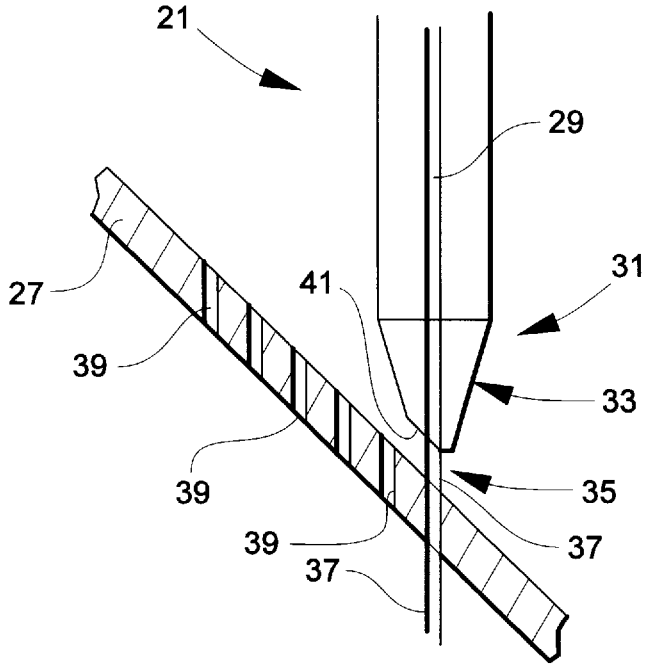
FIG. 2 is a detailed view of the device illustrated in FIG. 1 showing the liquid abrasive jet focusing tube and the workpiece with precision cuts made therein.

FIG. 2 shows in detail the focusing tube 21 positioned immediately adjacent the workpiece 27 for cutting operations thereon. The focusing tube 21 of the liquid abrasive jet system cutting unit 25 is subjected to contact with the abrasive particles in the jet and can therefore erode or wear in use. Consequently, the focusing tube 21 is typically made from carbide or other material which exhibits a high degree of wear resistance.

Figure 3:
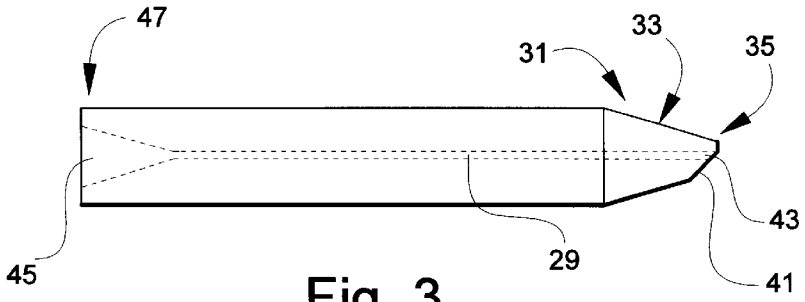
FIG. 3 is a side elevational view of the liquid abrasive jet focusing tube of the present invention.

A passage 29 extends from an inlet end 47, best seen in FIG. 3, through the focusing tube 21, and is directed outwardly therefrom at an outlet end 31. The outlet end 31 includes a generally frusto-conical tip portion 33 which has a vertex 35. It should be noted that the tip portion 33 need not be formed in a frusto-conical configuration and could be formed in, for example, a generally cylindrical shape. Liquid abrasive jet 37 is directed outwardly from the outlet end 31 for precision cutting of the workpiece 27, with kerfs 39 in the workpiece 27 illustrating cuts which have already been made. An angled surface 41 on the tip portion 33 is oriented generally parallel to the surface of the workpiece 27.

In FIG. 3, the entire length of the focusing tube 21 can be seen, with the passage 29 extending from an outlet opening 43 at the vertex 35 to an inlet opening 45 at the inlet end 47. The longitudinal axis formed by the passage 29 as it extends from the inlet end 47 to the outlet end 31 is readily apparent. The angled surface 41 is oriented at an angular relation to the axis of the passage 21 at generally the same angle as the non-perpendicular angle of the cuts to be made in the workpiece 27. Thus, when the angled surface 41 is positioned generally parallel to the surface of the workpiece 27, as in FIG. 2, the axis of the passage 29, and hence the jet 37 directed outwardly therefrom, will be oriented to form a cut in the workpiece 27 at the desired angle.

Figure 4:
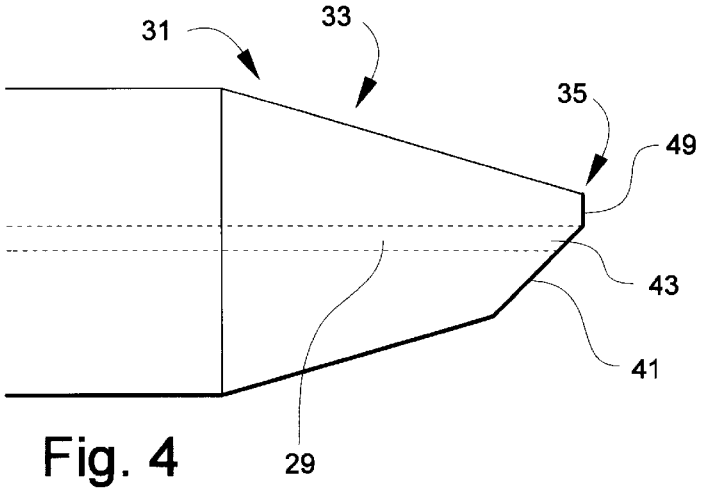
FIG. 4 is a detailed view of the focusing tube illustrated in FIG. 3 showing the tip portion of the focusing tube.
Figure 5:
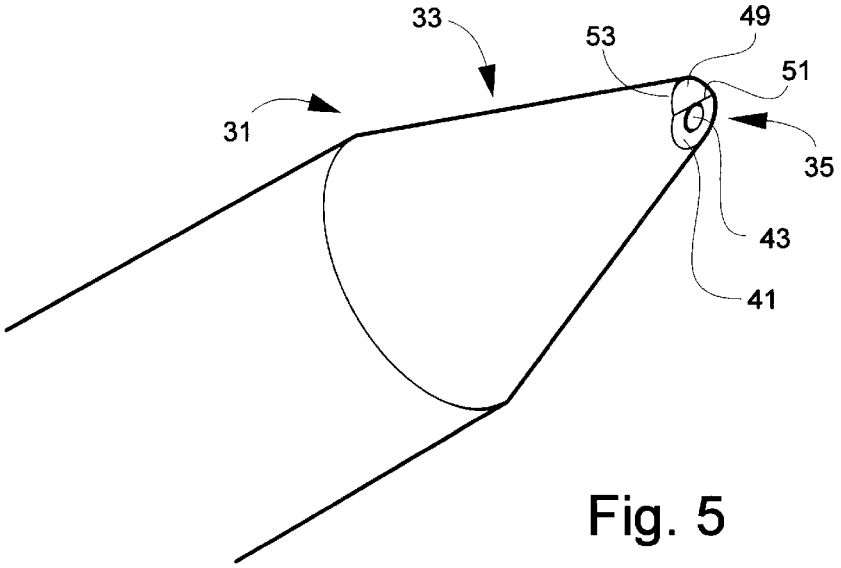
FIG. 5 is a perspective view of the outlet end of the focusing tube of the present invention showing the outlet opening and the angled surface.

The outlet end 31 of the focusing tube 21 is shown in greater detail in FIG. 4. The angled surface 41 is collinear with the outlet opening 43 and is also adjacent to and intersects with a planar surface 49 that is formed at a generally perpendicular angle to the axis of the passage 29. As can be seen in FIG. 5, the planar surface 49 and the angled surface 41 are bordered by an arris 51 which is formed generally tangent to the cylindrical side walls of the passage 29. The arris 51 also forms a chord of an arc 53, which likewise forms a border of the planar surface 49. The arrangement of the planar surface 49 and the angled surface 41 provides the passage 29 with substantial side walls along its entire length and avoids any knife-edged or thin-walled areas which could result in a structurally weakened focusing tube 21.

In operation, the focusing tube 21 of the present tube is positioned as shown in FIG. 2 with the angled surface 41, as noted above, generally parallel to the surface of the workpiece 27. In this arrangement, it is possible to position the focusing tube 21 so that the distance between the outlet opening 43 and the surface of the workpiece 27 is minimized, which thereby prevents excessive dispersion of the jet 37 prior to striking the workpiece 27. By preventing such dispersion, the overall cutting effectiveness of the liquid abrasive jet 37 is enhanced, and the capability of jet 37 to make precision cuts is maintained in that the size of kerfs 39 is reduced.

Some stand-off distance between the outlet opening 43 and the workpiece 27 is necessary in order to prevent unintended collisions between the focusing tube 21 and the workpiece 27, but the design of the focusing tube 21 of the present invention allows such stand-off distance to be kept advantageously to a minimum. Moreover, even in the event of such unintended collisions, the focusing tube 21 of the present invention is less likely to suffer chipping or other damage to its tip portion 33, given that the arrangement of the angled surface 41 and the planar surface 49 prevent the focusing tube 21 from having any extremely thin-walled sections, which would be highly vulnerable to breakage. While the present device is applied to liquid abrasive jets, its principles are generally applicable to air or other fluid abrasive jets.

The advantages of the focusing tube 21 of the present invention are highly significant in that allowing the liquid abrasive jet 37 to maintain a high degree of cutting effectiveness permits the jet 37 to be used to make non-perpendicular cuts in extremely hard materials such as the aforementioned tool steel, aluminum, cast iron armor plate, ceramics, and bulletproof glass, as well as others. Moreover, the small kerf made in such materials by the jet directed from the focusing tube 21 of the present invention allows intricate cuts to be made with a high degree of precision and reliability. The small size of the kerf thereby produced allows, for example, extremely small radius curves to be cut with a high degree of accuracy. As used herein, "cut" is meant to include incisions and openings of any configuration made by a jet cutting system in a workpiece, including those which are round or of other shapes. "Cut" thus includes holes, grooves, and notches, as well as other forms of incisions and openings.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method of making a precision cut with a liquid abrasive jet in a surface of a workpiece at a predetermined non-perpendicular angle therewith, said method comprising:

providing a liquid abrasive jet focusing tube having a body with an inlet end defining an inlet opening, an opposed outlet end defining an outlet opening, and a cylindrical central passage extending linearly between said inlet end and said outlet end, said passage being in communication with said openings and having a longitudinal axis, said outlet end including a tip portion having an angled surface in which said outlet opening extends through said angled surface and said angled surface being oriented in relation to said axis generally at the predetermined non-perpendicular angle;

positioning said focusing tube so that said angled surface is generally parallel to the workpiece surface and said axis is oriented in angular relation to said workpiece surface substantially at the predetermined non-perpendicular angle; and propelling said abrasive liquid jet through said passage of said focusing tube, out of said outlet opening and onto said workpiece surface to make a precision cut through said workpiece.

2. A liquid abrasive jet focusing tube for use in a liquid abrasive jet cutting system to form a precision cut in a workpiece at a predetermined non-perpendicular angle with a surface of the workpiece, said focusing tube comprising:

a body having an inlet end defining an inlet opening, an opposed outlet end defining an outlet opening, and a cylindrical central passage extending linearly between said end inlet end and said outlet ends, said passage being in communication with said openings and having a longitudinal axis; and said outlet end including a tip portion formed with an angled surface, in which said outlet opening extends through said angled surface, and said angled surface being oriented in relation to said axis generally at the predetermined non-perpendicular angle.

3. A liquid abrasive jet focusing tube according to claim 2, wherein said tip portion is generally frusto-conical in form and has a vertex extending outwardly from said body, said outlet opening being disposed at said vertex.

4. A liquid abrasive jet focusing tube according to claim 3, wherein said passage is formed by cylindrical walls having a circumference, said substantially planar surface is formed with an arcuate portion bordered by an arc and a chord of said arc, said chord being formed generally tangent to said circumference of said walls at said vertex, and said angled surface is bordered by said chord.

5. A liquid abrasive jet focusing tube according to claim 3, wherein said tip portion tapers to said vertex along a predetermined angle of taper in relation to said axis, with said angle of orientation of said angled surface being greater than said angle of taper.

6. A liquid abrasive jet focusing tube according to claim 2, further including a substantially planar surface adjacent said outlet opening, said substantially planar surface being oriented substantially perpendicular to said axis.

7. A liquid abrasive jet focusing tube according to claim 2, wherein said angled surface is formed with said outlet opening therein.

8. In combination, a workpiece having a surface in which a precision cut is to be made at a predetermined non-perpendicular angle therewith, and a liquid abrasive jet focusing tube, said focusing tube comprising:

a body having an inlet end defining an inlet opening, an opposed outlet end defining an outlet opening, and a cylindrical central passage extending linearly between said inlet end and said outlet end, said passage being in communication with said openings and having a longitudinal axis; and said outlet end including a tip portion having an angled surface in which said outlet opening extends through said angled surface and said angled surface being oriented in relation to said axis generally at the predetermined non-perpendicular angle, with said angled surface being oriented generally parallel to said workpiece surface and said axis being oriented in angular disposition to said workpiece surface generally at the predetermined non-perpendicular angle.

* * * * *

UNITED STATES PATENT AND TRADEMARK OFFICE

CERTIFICATE OF CORRECTION

PATENT NO. : 5,860,849

DATED : January 19, 1999

INVENTOR(S) : Miller

It is certified that error appears in the above-identified patent and that said Letters Patent is hereby corrected as shown below:

Title page: Add item [73]

Huffman Corporation

Clover, South Carolina 29710

Signed and Sealed this

Twenty-second Day of August, 2000

*Attest:*

Q. TODD DICKINSON

*Attesting Officer*

*Director of Patents and Trademarks*